US007540050B1

(12) United States Patent
Nazer

(10) Patent No.: US 7,540,050 B1
(45) Date of Patent: Jun. 2, 2009

(54) PREGNANCY SUPPORT PILLOW

(76) Inventor: Julie Nazer, 42 N. 700 East (120-5), Roosevelt, UT (US) 84066

( * ) Notice: Subject to any disclaimer, the term of this patent is extended or adjusted under 35 U.S.C. 154(b) by 0 days.

(21) Appl. No.: 11/639,844

(22) Filed: Dec. 15, 2006

(51) Int. Cl.
*A47C 16/00* (2006.01)
*A47C 20/00* (2006.01)

(52) U.S. Cl. ..... 5/632; 5/633; 5/655.3

(58) Field of Classification Search ..... 5/631–633, 5/655.3, 644, 645, 657
See application file for complete search history.

(56) References Cited

U.S. PATENT DOCUMENTS 4,054,960 A * 10/1977 Pettit et al. ..... 5/631
6,751,817 B1 * 6/2004 Leach ..... 5/632
6,874,183 B1 * 4/2005 Taylor ..... 5/632
7,089,614 B1 * 8/2006 Clapp ..... 5/632
7,114,206 B2 * 10/2006 Leach ..... 5/632
7,331,073 B2 * 2/2008 Littlehorn et al. ..... 5/655

* cited by examiner

*Primary Examiner*—Michael Trettel

(57) ABSTRACT

Pregnancy support pillows provide support to a pregnant woman lying on her side. A head support, back support, thigh support, and stomach support are connected end-to-end in a C-shaped configuration. The back support is curved. A cover encloses the supports and defines a hollow between the cover and the supports. The supports define first, second, third, fourth, and fifth air chambers, respectively. Each air chamber has a separate valve in fluid communication with it. A pocket is attached to the cover adjacent to the thigh support and receives the stomach support when the stomach support is deflated. Padding fills a portion of the hollow between the cover and the supports.

17 Claims, 3 Drawing Sheets

PREGNANCY SUPPORT PILLOW

BACKGROUND OF THE INVENTION

1. Field of the Invention

The present invention relates to a pregnancy support pillow for use in connection with support pillows. The pregnancy support pillow has particular utility in connection with providing support to a pregnant woman lying on her side.

2. Description of the Prior Art

Pregnancy support pillows are desirable for providing support to a pregnant woman lying on her side. Many pregnant women are required to sleep on their sides as their pregnancy advances to avoid disturbances in blood flow caused by pressure of the baby on large blood vessels. A variety of devices are known that address this problem.

The use of contoured body pillows is known in the prior art. For example, U.S. Pat. No. 6,751,817 to Leach discloses a contoured body pillow. However, the Leach '817 patent does not have an air chamber, and has further drawbacks of lacking a valve.

United States Patent Application Publication Number 2006/0042012 to Littlehorn discloses a pregnancy support pillow that supports a pregnant woman. However, the Littlehorn 2006/0042012 patent application publication does not have a plurality of air chambers, and additionally does not have a plurality of valves.

Similarly, U.S. Pat. No. 6,760,934 to Leach discloses a symmetrically contoured support pillow that supports an adult in a sleeping position. However, the Leach '934 patent does not have a plurality of air chambers, and cannot have a plurality of valves.

In addition, U.S. Pat. No. 6,499,164 to Leach discloses a body pillow with horseshoe-shaped top and J-shaped bottom that accommodates the upper and lower portion of a person. However, the Leach '164 patent does not have an air chamber, and also does not have a valve.

Furthermore, U.S. Pat. No. 6,088,854 to Brownrigg discloses a lateral body-supporting pillow that supports various portions of the body. However, the Brownrigg '854 patent does not have an air chamber, and further lacks a valve.

U.S. Pat. No. 6,052,848 to Kelly discloses a body support pillow that provides stable cushioned support to individuals. However, the Kelly '848 patent does not have an air chamber, and has the additional deficiency of lacking a valve.

In addition, U.S. Pat. No. Des. 420,845 to Rumage discloses a neck support pillow that supports the neck. However, the Rumage '845 patent does not have an air chamber, and also does not have a valve.

Furthermore, United States Patent Application Publication Number 2006/0037142 to Binder discloses a support with buoyancy cushions that supports at least a part of the human body. However, the Binder 2006/0037142 patent application publication does not have an air chamber, and further lacks a valve.

U.S. Pat. No. 6,671,908 to Error! Reference source not found. discloses an inflatable support pillow and methods that provides a support pillow. However, the Error! Reference source not found. '908 patent does not have a pocket, and has the additional deficiency of not simultaneously supporting a person's head, back, thigh, and stomach.

Lastly, U.S. Pat. No. 5,708,999 to Priolo et al. discloses an adjustable therapeutic pillow that supports the head and neck during sleep. However, the Priolo et al. '999 patent does not have a plurality of valves, and has the additional deficiency of not simultaneously supporting a person's head, back, thigh, and stomach.

While the above-described devices fulfill their respective, particular objectives and requirements, the aforementioned patents do not describe a pregnancy support pillow that allows providing support to a pregnant woman lying on her side.

Therefore, a need exists for a new and improved pregnancy support pillow that can be used for providing support to a pregnant woman lying on her side. In this regard, the present invention substantially fulfills this need. In this respect, the pregnancy support pillow according to the present invention substantially departs from the conventional concepts and designs of the prior art, and in doing so provides an apparatus primarily developed for the purpose of providing support to a pregnant woman lying on her side.

SUMMARY OF THE INVENTION

In view of the foregoing disadvantages inherent in the known types of contoured body pillows now present in the prior art, the present invention provides an improved pregnancy support pillow, and overcomes the above-mentioned disadvantages and drawbacks of the prior art. As such, the general purpose of the present invention, which will be described subsequently in greater detail, is to provide a new and improved pregnancy support pillow which has all the advantages of the prior art mentioned heretofore and many novel features that result in a pregnancy support pillow which is not anticipated, rendered obvious, suggested, or even implied by the prior art, either alone or in any combination thereof.

To attain this, the present invention essentially comprises a head support with one of its opposing ends attached to one of the opposing ends of a back support. A thigh support is attached to the back support opposite the head support. The head support defines a hollow comprising a first air chamber. The back support defines a hollow comprising a second air chamber. The thigh support defines a hollow comprising a fourth air chamber. A first valve is in fluid communication with the first air chamber. A second valve is in fluid communication with the second air chamber. A fourth valve is in fluid communication with the fourth air chamber.

There has thus been outlined, rather broadly, the more important features of the invention in order that the detailed description thereof that follows may be better understood and in order that the present contribution to the art may be better appreciated.

The invention may also include a third air chamber defined by a hollow in the back support. There may be a third valve in fluid communication with the third air chamber. There may be a cover enclosing the head support, back support, and thigh support. The cover may define a hollow. Padding may fill at least a portion of the hollow. The pregnancy support pillow may be generally C-shaped. There may be a pocket attached to the cover adjacent to the thigh support. There may be a stomach support with one of its opposing ends attached to one of the opposing ends of the thigh support opposite the back support. The stomach support may define a hollow comprising a fifth air chamber. There may be a fifth valve in fluid communication with the fifth air chamber. The first air chamber, second air chamber, fourth air chamber, and fifth air chamber may be made of inflatable plastic. The cover may be made of cotton. The padding may be foam rubber. The back support may be curved. The pregnancy support pillow may be about 4 to 5 feet long, 2 feet wide, and 6 to 8 inches thick. There are, of course, additional features of the invention that will be described hereinafter and which will form the subject matter of the claims attached.

Numerous objects, features, and advantages of the present invention will be readily apparent to those of ordinary skill in the art upon a reading of the following detailed description of presently current, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved pregnancy support pillow that has all of the advantages of the prior art contoured body pillows and none of the disadvantages.

It is another object of the present invention to provide a new and improved pregnancy support pillow that may be easily and efficiently manufactured and marketed.

An even further object of the present invention is to provide a new and improved pregnancy support pillow that has a low cost of manufacture with regard to both materials and labor, and which accordingly is then susceptible of low prices of sale to the consuming public, thereby making such pregnancy support pillow economically available to the buying public.

Still another object of the present invention is to provide a new pregnancy support pillow that provides in the apparatuses and methods of the prior art some of the advantages thereof, while simultaneously overcoming some of the disadvantages normally associated therewith.

Even still another object of the present invention is to provide a pregnancy support pillow for providing support to a pregnant woman lying on her side. This allows a pregnant woman to lie on her left side without experiencing blood flow disturbances.

Still yet another object of the present invention is to provide a pregnancy support pillow for providing support to a pregnant woman lying on her side. This makes it possible to prevent back and hip strain.

An additional object of the present invention is to provide a pregnancy support pillow for providing support to a pregnant woman lying on her side. This allows the firmness of each air chamber to be adjusted independently.

A further object of the present invention is to provide a pregnancy support pillow for providing support to a pregnant woman lying on her side. This enables the stomach support to be stored out of the way when it is not needed.

Lastly, it is an object of the present invention to provide a new and improved pregnancy support pillow for providing support to a pregnant woman lying on her side.

These together with other objects of the invention, along with the various features of novelty that characterize the invention, are pointed out with particularity in the claims annexed to and forming a part of this disclosure. For a better understanding of the invention, its operating advantages, and the specific objects attained by its uses, reference should be had to the accompanying drawings and descriptive matter in which there is illustrated current embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE CURRENT EMBODIMENT

Figure 1:
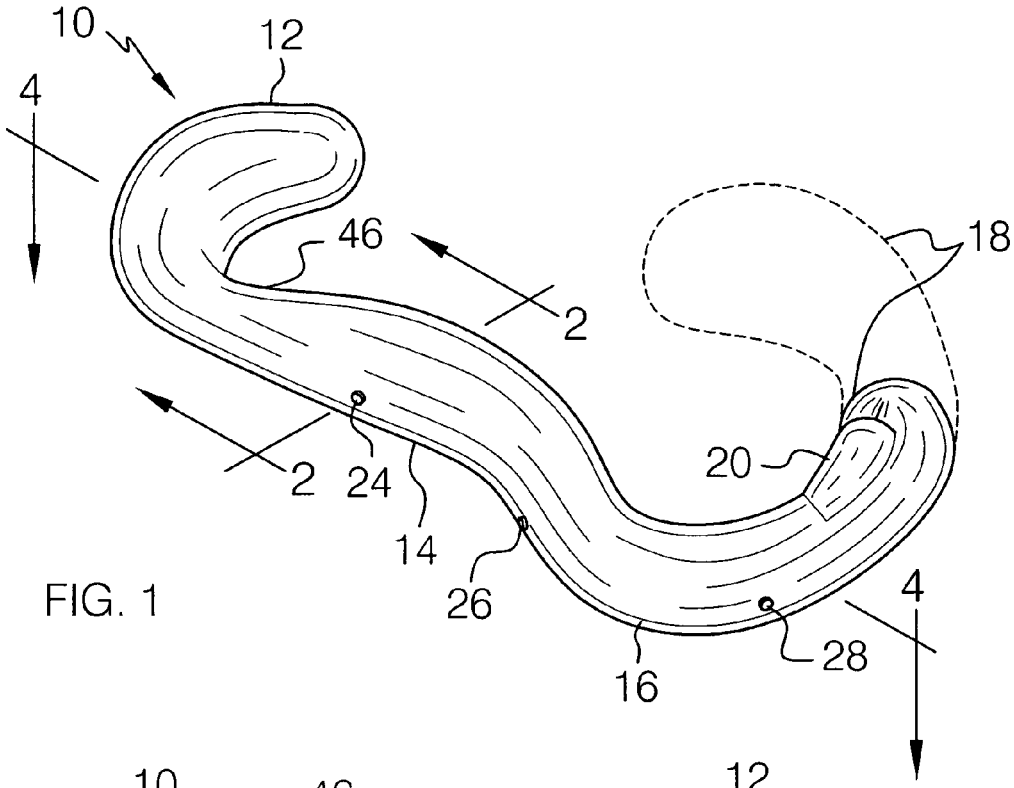
FIG. 1 is a top perspective view of the current embodiment of the pregnancy support pillow constructed in accordance with the principles of the present invention.

Referring now to the drawings, and particularly to FIGS. 1-4, a current embodiment of the pregnancy support pillow of the present invention is shown and generally designated by the reference numeral 10.

In FIG. 1, a new and improved pregnancy support pillow 10 of the present invention for providing support to a pregnant woman lying on her side is illustrated and will be described. More particularly, the pregnancy support pillow 10 has a head support 12 with one end attached to one end of a back support 14. The opposing end of back support 14 is attached to one end of thigh support 16. The opposing end of thigh support 16 is attached to one end of stomach support 18. A cover 46 encloses head support 12, back support 14, thigh support 16, and stomach support 18. A first valve 22 protrudes from head support 12 (visible in FIGS. 3 and 4). Second valve 24 and third valve 26 protrude from back support 14. Fourth valve 28 protrudes from thigh support 16. Fifth valve 30 protrudes from stomach support 18. A pocket 20 is attached to cover 46 adjacent to thigh support 16. FIG. 1 illustrates how stomach support 18 can be optionally deflated and stored within pocket 20 when stomach support 18 is not needed. In the current embodiment, the pregnancy support pillow 10 is generally C-shaped and back support 14 is curved. Cover 46 is made of cotton in the current embodiment, and the pregnancy support pillow 10 is about 4 to 5 feet long, 2 feet wide, and 6 to 8 inches thick.

Figure 2:
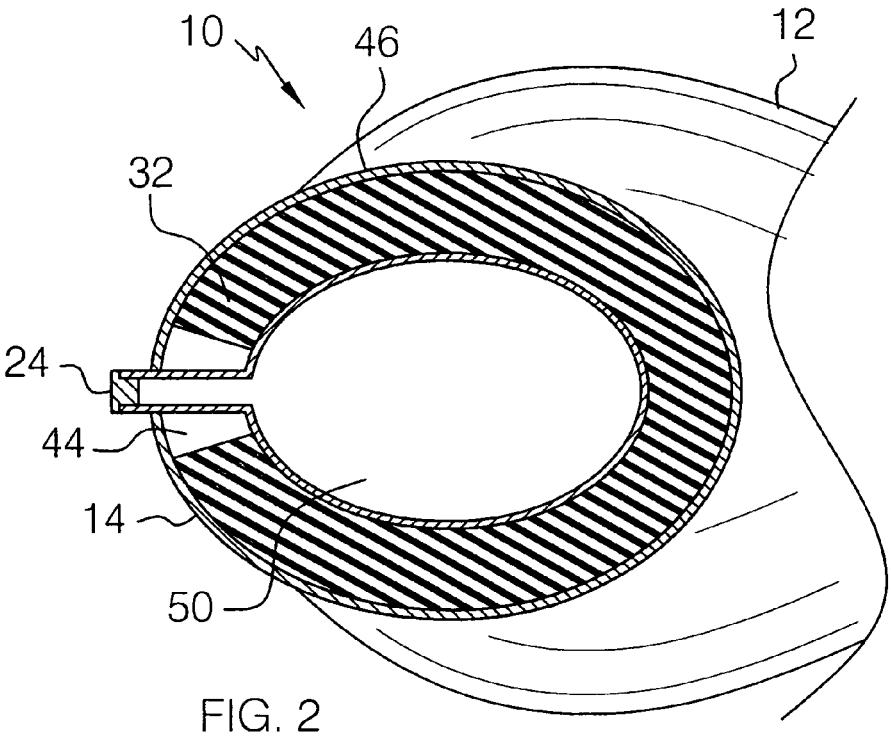
FIG. 2 is a side sectional view of the pregnancy support pillow of the present invention.

Moving on to FIG. 2, a new and improved pregnancy support pillow 10 of the present invention for providing support to a pregnant woman lying on her side is illustrated and will be described. More particularly, the pregnancy support pillow 10 has a back support 14 attached to one end of head support 12. Back support 14 defines a second air chamber 50. Cover 46 encloses head support 12 and back support 14, defining a hollow 44 between cover 46 and head support 12 and back support 14. Padding 32 fills a portion of hollow 44. Second valve 24 is in fluid communication with second air chamber 50. In the current embodiment, padding 32 is made of foam rubber.

Figure 3:
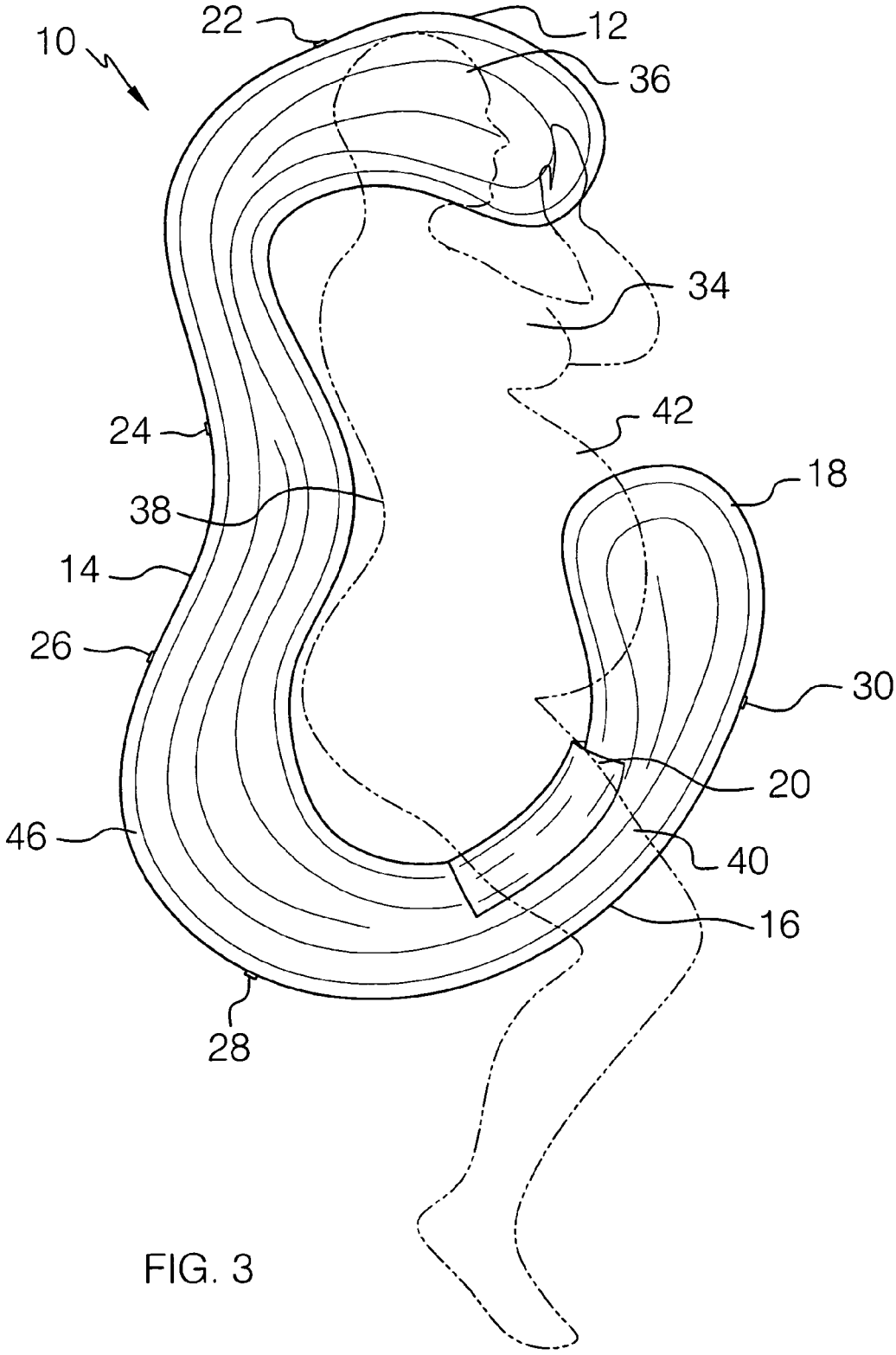
FIG. 3 is a top side view of the pregnancy support pillow of the present invention.

Continuing with FIG. 3, a new and improved pregnancy support pillow 10 of the present invention for providing support to a pregnant woman lying on her side is illustrated and will be described. More particularly, the pregnancy support pillow 10 is depicted in use by a pregnant woman 34. Her head 36 is supported by head support 12, her thigh 40 is supported by thigh support 16, her back 38 is supported by back support 14, and her stomach 42 is supported by stomach support 18. In the current embodiment, the back support 14 is curved to fit the curve of back 38. Note that the broken lines depicting pregnant woman 34, head 36, back 38, thigh 40, and stomach 42 are for illustrative purposes only and are not part of the current invention.

Figure 4:
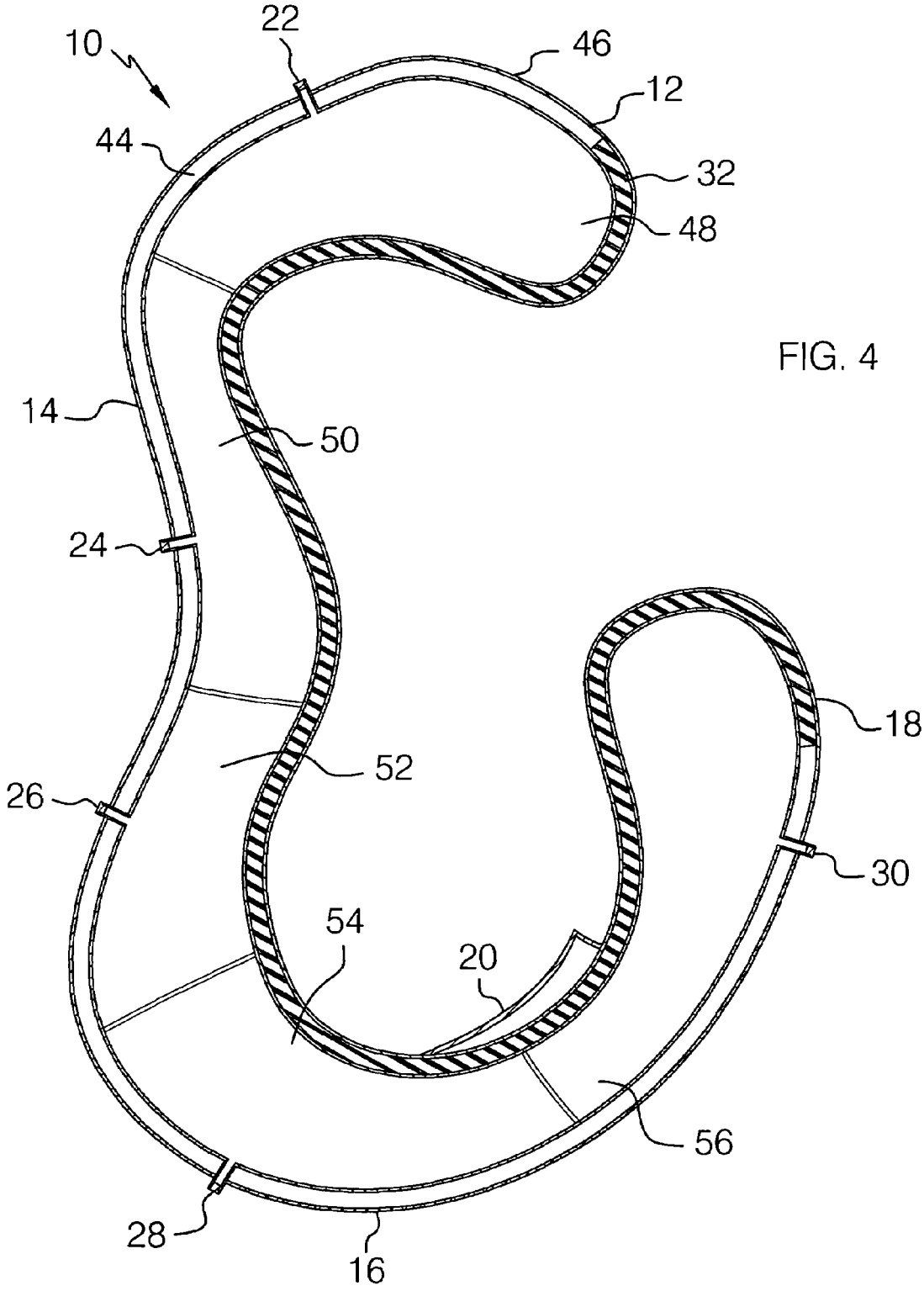
FIG. 4 is a top side sectional view of the pregnancy support pillow of the present invention.

Concluding with FIG. 4, a new and improved pregnancy support pillow 10 of the present invention for providing support to a pregnant woman lying on her side is illustrated and will be described. More particularly, the pregnancy support pillow 10 has a head support 12 with one end attached to one end of a back support 14. The opposing end of back support 14 is attached to one end of thigh support 16. The opposing end of thigh support 16 is attached to one end of stomach support 18. A cover 46 encloses head support 12, back support 14, thigh support 16, and stomach support 18. A first valve 22 protrudes from head support 12. Second valve 24 and third valve 26 protrude from back support 14. Fourth valve 28 protrudes from thigh support 16. Fifth valve 30 protrudes from stomach support 18. Pocket 20 is attached to cover 46 adjacent to thigh support 16. Head support 12 defines a first air chamber 48. Back support 14 defines a second air chamber 50 and third air chamber 52. Thigh support 16 defines a fourth air chamber 54. Stomach support 18 defines a fifth air chamber 56. Cover 46 encloses head support 12, back support 14, thigh support 16, and stomach support 18, defining a hollow 44 between cover 46 and head support 12, back support 14, thigh support 16, and stomach support 18. Padding 32 fills a portion of hollow 44 to provide the user with additional support beyond that provided by first air chamber 48, second air chamber 50, third air chamber 52, fourth air chamber 54, and fifth air chamber 56. First valve 22 is in fluid communication with first air chamber 48. Second valve 24 is in fluid communication with second air chamber 50. Third valve 26 is in fluid communication with third air chamber 52. Fourth valve 28 is in fluid communication with fourth air chamber 54. Fifth valve 30 is in fluid communication with fifth air chamber 56. In the current embodiment, first air chamber 48, second air chamber 50, third air chamber 52, fourth air chamber 54, and fifth air chamber 56 are made from inflatable plastic. Third air chamber 52, third valve 26, pocket 20, fifth air chamber 56, fifth valve 30, and stomach support 18 are optional components of the pregnancy support pillow 10. In the current embodiment, first air chamber 48, second air chamber 50, third air chamber 52, fourth air chamber 54, and fifth air chamber 56 are not in fluid communication with one another.

In use, it can now be understood that a pregnant woman 34 obtains the pregnancy support pillow 10 and adjust the level of inflation of first air chamber 48, second air chamber 50, third air chamber 52, fourth air chamber 54, and fifth air chamber 56 using first valve 22, second valve 24, third valve 26, fourth valve 28, fifth valve 30, and an air pump if required so that the head support 12, back support 14, thigh support 16, and stomach support 18 provide the desired level of support. The pregnant woman 34 then lies on her side with the pregnancy support pillow 10 extending behind her back 38, under her head 36, between her thighs 40, and (optionally) underneath her stomach 42. During early stages of the pregnancy, or after the pregnancy, the stomach support 18 can be deflated and folded neatly into pocket 20 when it is not needed.

While a current embodiment of the pregnancy support pillow has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable flexible material such as polyester or any other variety of fabric may be used instead of the cotton cover described. Also, the inflatable plastic air chambers may also be made of rubber or similar material. And although providing support to a pregnant woman lying on her side has been described, it should be appreciated that the pregnancy support pillow herein described is also suitable for providing support to obese persons and those suffering ailments of the lower back or other orthopedic problems that would benefit from full-body support while sipping resting. Furthermore, a wide variety of air chamber configurations may be used instead of the five air chambers described.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pregnancy support pillow comprising:

a head support having opposing ends;

a back support having opposing ends with one of said opposing ends attached to one of said opposing ends of said head support;

a thigh support having opposing ends with one of said opposing ends attached to said one of said opposing ends of said back support opposite said head support;

a first air chamber, wherein said head support defines a hollow therein comprising said first air chamber;

a second air chamber, wherein said back support defines a hollow therein comprising said second air chamber;

a third air chamber, wherein said back support defines a hollow therein comprising said third air chamber; and a fourth air chamber, wherein said thigh support defines a hollow therein comprising said fourth air chamber;

a first valve in fluid communication with said first air chamber;

a second valve in fluid communication with said second air chamber;

a third valve in fluid communication with said third air chamber; and a fourth valve in fluid communication with said fourth air chamber.

2. The pregnancy support pillow as defined in claim 1, wherein said back support is curved.

3. A pregnancy support pillow comprising:

a head support having opposing ends;

a back support having opposing ends with one of said opposing ends attached to one of said opposing ends of said head support;

a thigh support having opposing ends with one of said opposing ends attached to said one of said opposing ends of said back support opposite said head support;

a first air chamber, wherein said head support defines a hollow therein comprising said first air chamber;

a second air chamber, wherein said back support defines a hollow therein comprising said second air chamber;

a fourth air chamber, wherein said thigh support defines a hollow therein comprising said fourth air chamber;

a first valve in fluid communication with said first air chamber;

a second valve in fluid communication with said second air chamber; and a fourth valve in fluid communication with said fourth air chamber;

a cover enclosing said head support, back support, and thigh support;

a hollow, wherein said cover defines a hollow therein to comprise said hollow; and padding filling at least a portion of said hollow.

4. The pregnancy support pillow as defined in claim 3, wherein said padding is foam rubber.

5. A pregnancy support pillow comprising:

a head support having opposing ends;

a back support having opposing ends with one of said opposing ends attached to one of said opposing ends of said head support;

a thigh support having opposing ends with one of said opposing ends attached to said one of said opposing ends of said back support opposite said head support;

a first air chamber, wherein said head support defines a hollow therein comprising said first air chamber;

a second air chamber, wherein said back support defines a hollow therein comprising said second air chamber;

a fourth air chamber, wherein said thigh support defines a hollow therein comprising said fourth air chamber;

a first valve in fluid communication with said first air chamber;

a second valve in fluid communication with said second air chamber; and a fourth valve in fluid communication with said fourth air chamber;

wherein said pregnancy support pillow is generally C-shaped.

6. A pregnancy support pillow comprising:

a head support having opposing ends;

a back support having opposing ends with one of said opposing ends attached to one of said opposing ends of said head support;

a thigh support having opposing ends with one of said opposing ends attached to said one of said opposing ends of said back support opposite said head support;

a first air chamber, wherein said head support defines a hollow therein comprising said first air chamber;

a second air chamber, wherein said back support defines a hollow therein comprising said second air chamber;

a fourth air chamber, wherein said thigh support defines a hollow therein comprising said fourth air chamber;

a first valve in fluid communication with said first air chamber;

a second valve in fluid communication with said second air chamber; and a fourth valve in fluid communication with said fourth air chamber;

a cover enclosing said head support, back support, and thigh support; and a pocket attached to said cover adjacent to said thigh support.

7. A pregnancy support pillow comprising:

a head support having opposing ends;

a back support having opposing ends with one of said opposing ends attached to one of said opposing ends of said head support;

a thigh support having opposing ends with one of said opposing ends attached to said one of said opposing ends of said back support opposite said head support;

a stomach support having opposing ends with one of said opposing ends attached to one of said opposing ends of said thigh support opposite said back support;

a first air chamber, wherein said head support defines a hollow therein comprising said first air chamber;

a second air chamber, wherein said back support defines a hollow therein comprising said second air chamber;

a fourth air chamber, wherein said thigh support defines a hollow therein comprising said fourth air chamber;

a fifth air chamber, wherein said stomach support defines a hollow therein comprising said fifth air chamber;

a first valve in fluid communication with said first air chamber;

a second valve in fluid communication with said second air chamber;

a fourth valve in fluid communication with said fourth air chamber; and a fifth valve in fluid communication with said fifth air chamber.

8. The pregnancy support pillow as defined in claim 7, wherein said first air chamber, said second air chamber, said fourth air chamber, and said fifth air chamber are made of inflatable plastic.

9. The pregnancy support pillow as defined in claim 7, wherein said pregnancy support pillow is about 4 to 5 feet long, 2 feet wide, and 6 to 8 inches thick.

10. A pregnancy support pillow comprising:

a head support having opposing ends;

a back support having opposing ends with one of said opposing ends attached to one of said opposing ends of said head support;

a thigh support having opposing ends with one of said opposing ends attached to said one of said opposing ends of said back support opposite said head support;

a first air chamber, wherein said head support defines a hollow therein comprising said first air chamber;

a second air chamber, wherein said back support defines a hollow therein comprising said second air chamber;

a third air chamber, wherein said back support defines a hollow therein comprising said third air chamber;

a fourth air chamber, wherein said thigh support defines a hollow therein comprising said fourth air chamber;

a first valve in fluid communication with said first air chamber;

a second valve in fluid communication with said second air chamber;

a third valve in fluid communication with said third air chamber; and a fourth valve in fluid communication with said fourth air chamber.

11. The pregnancy support pillow as defined in claim 10, further comprising a cover enclosing said head support, back support, and thigh support.

12. The pregnancy support pillow as defined in claim 11, further comprising:

a hollow, wherein said cover defines a hollow therein to comprise said hollow; and padding filling at least a portion of said hollow.

13. The pregnancy support pillow as defined in claim 11, further comprising a pocket attached to said cover adjacent to said thigh support.

14. The pregnancy support pillow as defined in claim 10, further comprising:

a stomach support having opposing ends with one of said opposing ends attached to one of said opposing ends of said thigh support opposite said back support;

a fifth air chamber, wherein said stomach support defines a hollow therein comprising said fifth air chamber; and a fifth valve in fluid communication with said fifth air chamber.

15. A pregnancy support pillow comprising:

a head support having opposing ends;

a back support having opposing ends with one of said opposing ends attached to one of said opposing ends of said head support;

a thigh support having opposing ends with one of said opposing ends attached to said one of said opposing ends of said back support opposite said head support;

a stomach support having opposing ends with one of said opposing ends attached to one of said opposing ends of said thigh support opposite said back support;

a first air chamber, wherein said head support defines a hollow therein comprising said first air chamber;

a second air chamber, wherein said back support defines a hollow therein comprising said second air chamber;

a third air chamber, wherein said back support defines a hollow therein comprising said third air chamber;

a fourth air chamber, wherein said thigh support defines a hollow therein comprising said fourth air chamber;

a fifth air chamber, wherein said stomach support defines a hollow therein comprising said fifth air chamber;

a first valve in fluid communication with said first air chamber;

a second valve in fluid communication with said second air chamber;

a third valve in fluid communication with said third air chamber;

a fourth valve in fluid communication with said fourth air chamber; and a fifth valve in fluid communication with said fifth air chamber.

16. The pregnancy support pillow as defined in claim 15, further comprising:

a cover enclosing said head support, back support, thigh support, and said stomach support;

a hollow, wherein said cover defines a hollow therein to comprise said hollow; and padding filling at least a portion of said hollow.

17. The pregnancy support pillow as defined in claim 16, further comprising a pocket attached to said cover adjacent to said thigh support.

* * * * *